US006511549B1

(12) United States Patent
Ercelebi et al.

(10) Patent No.: US 6,511,549 B1
(45) Date of Patent: Jan. 28, 2003

(54) VACUUM CLEANING WHEEL AND VACUUM APPLICATOR

(75) Inventors: Ahmet Ercelebi, Richmond, VA (US); Steven Frederick Spiers, Richmond, VA (US); Jeremy J. Straight, Midlothian, VA (US)

(73) Assignee: Philp Morris Incorporated, New York, NY (US)

( * ) Notice: Subject to any disclaimer, the term of this patent is extended or adjusted under 35 U.S.C. 154(b) by 0 days.

(21) Appl. No.: 09/931,382

(22) Filed: Aug. 17, 2001

(51) Int. Cl.[7] ..... B01B 5/04
(52) U.S. Cl. ..... 134/21; 15/309.2
(58) Field of Search ..... 134/21; 15/309.2, 15/306.1, 309.1, 308

(56) References Cited

U.S. PATENT DOCUMENTS

| | | | | |
|---|---|---|---|---|
| 3,119,140 A | * | 1/1964 | Sallet | 15/309.1 |
| 3,341,882 A | * | 9/1967 | Morello | 15/309.1 |
| 3,475,782 A | * | 11/1969 | Tember | 15/100 |
| 3,974,007 A | | 8/1976 | Greve | |
| 4,167,797 A | * | 9/1979 | Wilde et al. | 15/302 |
| 4,541,826 A | | 9/1985 | Warner | |
| 4,888,848 A | * | 12/1989 | Serracant-Clermont et al. | 15/309.1 |
| 4,969,551 A | | 11/1990 | Heitmann et al. | |
| 5,012,548 A | * | 5/1991 | Jeffries | 15/308 |
| 5,339,871 A | | 8/1994 | Collins et al. | |
| 5,542,901 A | | 8/1996 | Atwell et al. | |
| 5,645,087 A | | 7/1997 | Chehab et al. | |
| 5,738,115 A | | 4/1998 | Chehab et al. | |
| 5,809,744 A | | 9/1998 | Villines et al. | |
| 6,412,140 B1 | * | 7/2002 | Fleissner | 15/309.1 |
| 6,415,474 B1 | * | 7/2002 | Schmidt | 15/309.2 |

* cited by examiner

*Primary Examiner*—Chris K. Moore
(74) *Attorney, Agent, or Firm*—Burns, Doane, Swecker & Mathis, LLP

(57) ABSTRACT

A vacuum cleaning wheel and vacuum applicator having a stationary vacuum chamber, a ported wheel that rotates around the stationary vacuum chamber, and a stationary shoe that acts as the vacuum applicator and is positioned between the ported wheel and an article such as a cigarette filter rod to be cleaned. An article or articles having cavities filled with granular particles is passed underneath the stationary shoe and rotating ported wheel, with the movement of the article being synchronized with the rotation of the ported wheel. The stationary shoe provided between the rotating ported wheel and the article having particle filled cavities ensures that vacuum is only applied to remove loose particles in between the particle filled cavities, with vacuum being cut off abruptly to ports that are passing over the particle filled cavities and with the particles that have been cleaned being removed completely.

17 Claims, 7 Drawing Sheets

VACUUM CLEANING WHEEL AND VACUUM APPLICATOR

FIELD OF THE INVENTION

The present invention relates generally to an apparatus and method for removing undesired granular particles that may remain on surfaces of an article surrounding a cavity that has been filled with the granular particles. More particularly, the invention provides an apparatus and method for removing scattered granular particles from surfaces of a combined filter rod made up of filter components and particle filled cavities.

BACKGROUND OF THE INVENTION

Certain articles of manufacture such as charcoal cigarette filters, individual-sized packets of granular food products or condiments, capsuled pharmaceuticals, ammunition and the like require repetitive placement of precisely metered charges of particulate matter at some location along the production-line of the articles.

The high speed production of a quality product requires that accurate amounts of the granular particles be inserted only into desired cavities, with excess particles being removed from the surrounding surfaces of the article while the article continues to be processed at high speeds. While it has been known to apply vacuum to remove scattered material from sites intended to be free of material so as to enhance cleanliness of the operation, existing means for removing scattered particles from the undesired areas have suffered from the problem of also removing particles from the desired locations such as particle filled cavities. This problem has been compounded during high speed manufacture of articles such as cigarette filter rods since no means has been provided to prevent the application of vacuum over areas of the article where granular particles should not be disturbed, while at the same time ensuring that undesired particles that have been vacuumed are removed completely.

SUMMARY OF THE INVENTION

In view of the above problems of prior art systems for cleaning articles during manufacture, the present invention is embodied in a system that includes a ported wheel rotating around a stationary vacuum chamber, and a stationary shoe or vacuum applicator that is positioned between the ported wheel and an article or articles having cavities to be filled with particles. The article or articles can be moved along a vacuum rail underneath the ported wheel so that the cavities travel in synchronization with the ports in the ported wheel. The placement of ports in the ported wheel and the design of the stationary shoe allow the system to clean particles from different length surfaces of the article interspersed between the cavities where it is desired to leave the particles undisturbed.

The ports through the ported wheel allow vacuum to be communicated from a stationary vacuum chamber within the wheel to the stationary shoe or vacuum applicator. The stationary shoe is provided with at least one concave upper surface segment that conforms closely to the outer circumferential surface of the ported wheel. The concave top surface of the stationary shoe can be divided into segments having different lengths in the direction of rotation of the ported wheel, with the different length segments being spaced in a direction parallel to the axis of rotation of the ported wheel and aligned with axially spaced ports of different lengths in the ported wheel.

A radial hole or slot is provided through the stationary shoe from the concave upper surface to a lateral groove or slot across the bottom surface of the stationary shoe. The lateral groove or slot across the bottom surface of the stationary shoe is positioned in close proximity to the top surface of an article, such as a cigarette filter rod, that is passing underneath the stationary shoe. In an embodiment of the invention, the article passing underneath the stationary shoe and rotating ported wheel can be a combined cigarette filter rod having alternating filter components and particle filled cavities. The particle filled cavities can be spaced along the filter rod at different distances from each other, separated by longer and shorter filter components.

As the filter rod travels underneath the stationary shoe and the ported wheel, the ported wheel is rotated in synchronization with the travel of the filter rod. As the filter rod travels under the stationary shoe, a tapered leading edge of the shoe scrapes loose particles from the surface of the filter rod. As a port in the ported wheel reaches the radial passageway through the stationary shoe, vacuum from the stationary vacuum chamber within the ported wheel is communicated through the radial passageway and through the cross groove on the lower surface of the shoe. This results in an air flow across the portions of the filter rod passing directly underneath the cross groove, which pulls away scattered particles that may lie on the filter components in between the particle-filled cavities. The timing of the ported wheel and the length of the port that is passing over the radial passageway through the shoe are predetermined such that air is only drawn across the filter component sections of the combined filter rod and, as a result, does not remove particles from the particle-filled cavities.

As the ported wheel continues to rotate past the point where vacuum is communicated through the port to the radial passageway through the stationary shoe, the port then begins to pass beyond the end of the concave segment it is aligned with on the upper surface of the stationary shoe such that ambient air is pulled through the port into the stationary vacuum chamber to completely remove any loose particles that have been removed from the surface of the article.

BRIEF DESCRIPTION OF THE DRAWINGS

The details and advantages of the invention will become apparent upon the consideration of the following detailed description, taken in conjunction with the accompanying drawings, in which each particular reference number refers to particular parts throughout. In the following figures.

DESCRIPTION OF THE PREFERRED EMBODIMENTS

The invention provides a vacuum cleaning system for removing scattered granules or particles along surfaces of an article or articles at locations between cavities containing the granules or particles. The system includes a ported wheel that rotates around a stationary vacuum chamber. The vacuum from the stationary vacuum chamber is communicated through the ports in the wheel and through a stationary vacuum applicator positioned between the ported wheel and the article to be cleaned. The vacuum applicator includes at least one portion that conforms to the ported wheel and at least one portion that conforms to the article, with at least one passageway connecting the conforming portions. Different ports on the ported wheel can be aligned with different portions of the vacuum applicator, to selectively communicate vacuum to an outer surface of the article at different positions and for different lengths of time as the article travels pass the vacuum applicator.

Figure 1A:
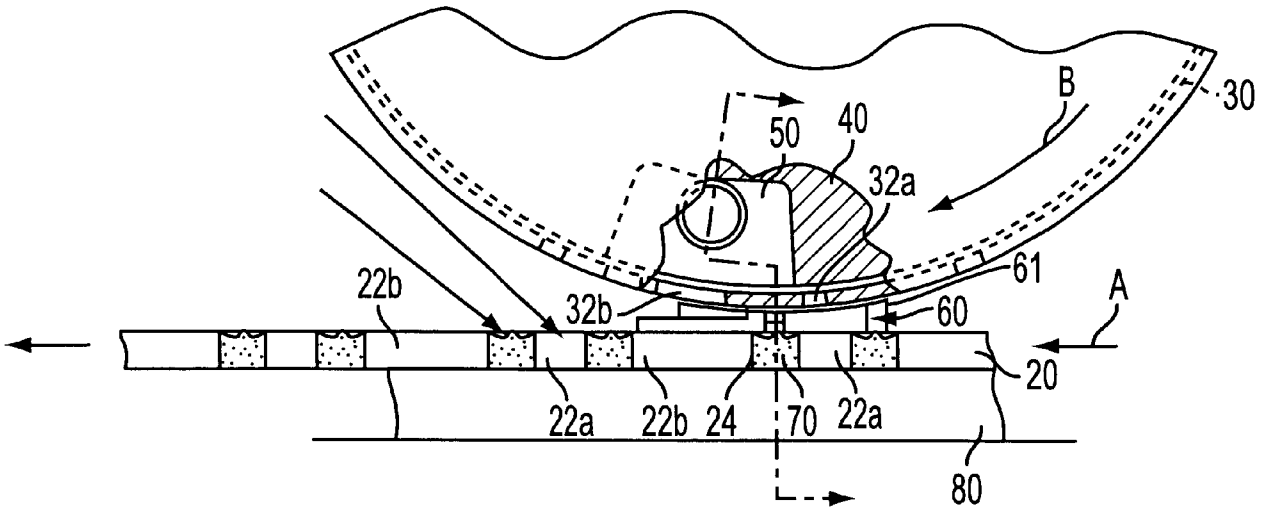
FIG. 1A illustrates a side elevation view of a cleaning system according to an embodiment of the invention.
Figure 1B:
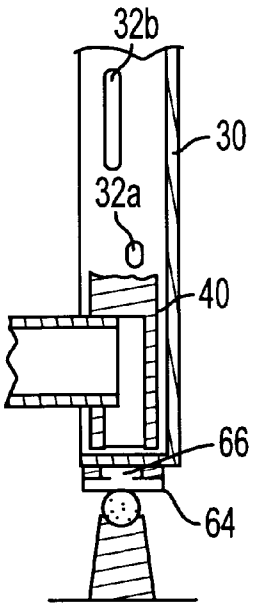
FIG. 1B illustrates a front elevation view of the system shown in FIG. 1A.

Referring initially to FIGS. 1A and 1B, a ported wheel 30 rotates around a stationary central drum 40 having a defined vacuum chamber 50. A stationary vacuum applicator in the form of a shoe 60 is positioned between the ported wheel 30 and an article 20 having spaced cavities 24 filled with granules or particles 70. In the embodiment shown in FIGS. 1A and 1B, the article is in the form of a combined filter rod 20, although any article or articles having sites where particles or granules are desired, spaced from each other by sites where no particles are desired, could be used. The filter rod 20 is shown being conveyed along a filter rod support rail 80. The support rail 80 can include the application of a vacuum to the underside of the combined filter rod 20, if desired. The vacuum can have the double action of pulling particles into the spaced cavities, thereby assisting in preventing the particles from being cleaned out of the cavities, as well as pulling away loose particles remaining in undesired areas that have not been cleaned by the vacuum wheel and shoe positioned above the combined filter rod. The combined filter rod 20 is formed of a plug wrap that is wrapped partially around filter components spaced in between particle filled cavities. In the embodiment shown in FIG. 1A, shorter filter components 22*a* are alternated with longer filter components 22*b*. The particle filled cavities 24 in between the filter components are filled with granular particles 70, such as charcoal. Although the illustrated embodiment includes a combined cigarette filter rod, alternative embodiments could be used to clean the surfaces of any article having cavities to be filled with granules or particles and surfaces surrounding the cavities that must be kept clean of the particles.

Figure 2A:
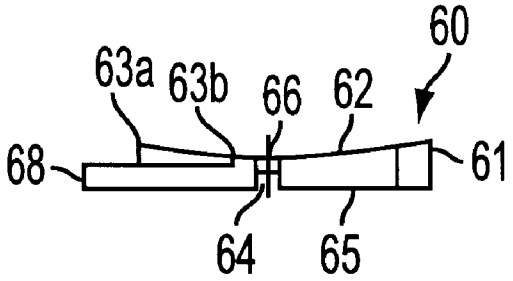
FIG. 2A illustrates a side elevation view of a cleaning shoe according to an embodiment of the invention.
Figure 2B:
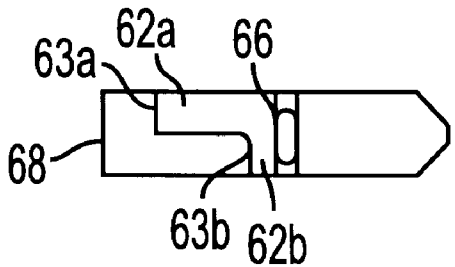
FIG. 2B illustrates a top plan view of the cleaning shoe shown in FIG. 2A.

A stationary shoe 60, shown in more detail in FIGS. 2A and 2B, is positioned immediately above the combined filter rod 20. The lower surface 65 of the stationary shoe 60 is positioned in close proximity to the upper surface of the combined filter rod 20.

A rotating ported wheel 30 is positioned above the stationary shoe 60 in close conforming relationship with an upper concave surface 62 of the stationary shoe 60. The ported wheel 30 rotates about a central stationary drum 40 that defines a stationary vacuum chamber 50. Ports 32*a* and 32*b* are provided through ported wheel 30 in order to communicate vacuum from the central stationary vacuum chamber 50 to the stationary shoe 60. Ports 32*a* can be formed through the ported wheel 30 as slots of a first shorter length, with alternating ports 32*b* being formed as axially offset slots of a second longer length. As best seen in FIG. 1B, the shorter port 32*a* is axially offset from longer port 32*b* in a direction parallel to the axis of rotation of the ported wheel 30 and circumferentially offset in a direction around the outer circumference of the wheel.

In conjunction with the shorter and longer ports 32*a*, 32*b* provided in the ported wheel 30, the upper conforming concave surface 62 of the stationary shoe 60 can be provided with a shorter concave segment 62*b* and a longer concave segment 62*a*, as shown in FIG. 2B. A radial passageway in the form of a hole or slot 66 is provided through stationary shoe 60 from the upper concave surface 62 to the bottom surface 65. The radial hole or slot 66 communicates with a cross groove 64 that extends laterally across at least part of the bottom surface 65 of stationary shoe 60. Although only one radial passageway 66 is shown, any suitable fluid communication arrangement could be used, e.g., a plurality of passageways could be provided through the shoe 60 to connect different conforming segments of the upper surface to one or more cross grooves extending across the lower surface of the shoe. The conforming segments of the vacuum applicator are provided with different lengths, and the aligned ports through the ported wheel are provided with different lengths to effect the application of vacuum over selected surfaces of an article passing by the vacuum applicator.

As the filter rod 20 travels in the direction represented by arrow A in FIG. 1A, the ported wheel 30 rotates in synchronization in the direction of arrow B in FIG. 1A. The cavities 24 between shorter and longer filter components 22*a*, 22*b*, have been filled with granules or particles 70 in a previous operation, with some of the particles being scattered in an undesired fashion along the surfaces of filter components 22*a*, 22*b*. As the filter rod 20 travels under the stationary shoe or vacuum applicator 60, the tapered leading edge 61 of the stationary shoe scrapes off some of the loose particles that may lie along the surface of filter components 22*a*, 22*b*.

As a port 32*a*, 32*b* through ported wheel 30 reaches the radial passageway 66 in the shoe 60, vacuum from the stationary vacuum chamber 50 can pull air through the radial passageway and through the cross groove 64 along the bottom surface 65 of the shoe 60. This results in an air flow across the portions of the filter rod passing directly beneath the cross groove 64, which removes scattered particles from the filter components 22*a*, 22*b*. The length of the ports 32*a*, 32*b* coincides with the length of a filter component 22*a*, 22*b* that is passing beneath the cross groove 64 while the corresponding port through the ported wheel is passing over the radial passageway 66 in shoe 60. The timing of the ported wheel 30 and the length of the ports 32*a*, 32*b* are synchronized such that air is only drawn across the filter components 22*a*, 22*b*, and does not remove the particles 70 from the particle filled cavities 24.

As ported wheel 30 continues to rotate, it reaches a position where the port 32*a*, 32*b* moves to a position which blocks the pull of air through the radial passageway 66 in shoe 60. Beyond this position, the port moves off of a corresponding concave segment 62*a*, 62*b* on the upper concave surface 62 of shoe 60. As a port moves off of a corresponding concave segment, ambient air rather than air pulled through the radial passageway 66 begins to enter the port to continue carrying the loose particles that have been cleaned off the filter components away through central vacuum chamber 50.

Although the embodiment shown in the figures only includes two different length ports through the ported wheel and two different length concave segments on the stationary shoe, one of ordinary skill in the art would recognize that additional ports of different lengths and additional segments of different lengths on the stationary shoe could be provided to compensate for additional length sections along an article or articles where it is desired to remove scattered granules or particles.

Figure 3A:
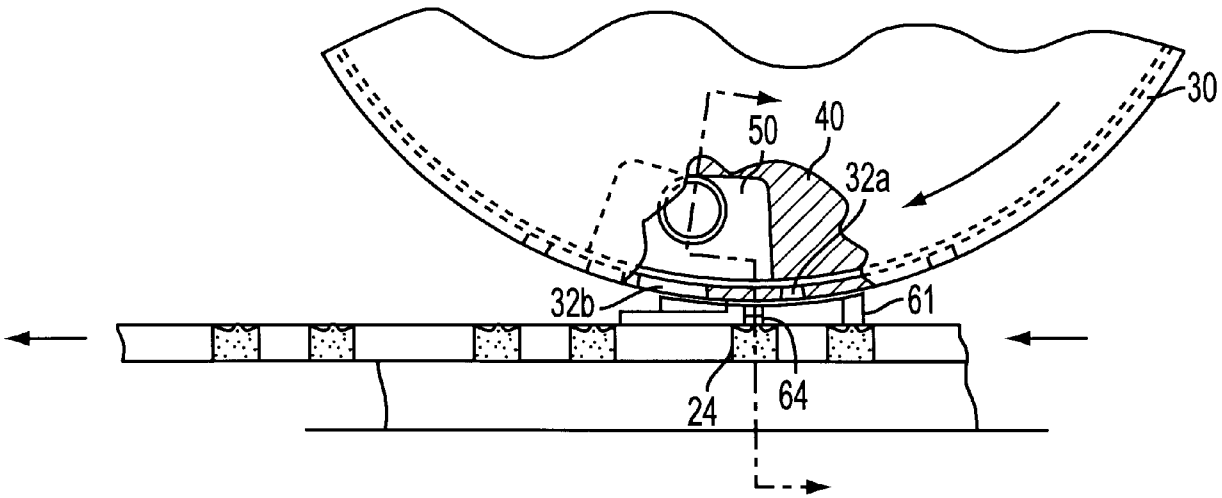
FIG. 3A illustrates a side elevation view of the cleaning system shown in FIG. 1A.
Figure 3B:
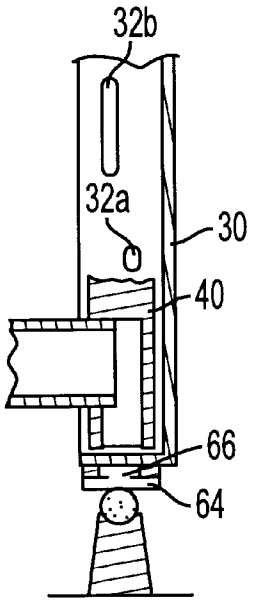
FIG. 3B illustrates a front elevation view of the cleaning system shown in FIG. 3A.
Figure 4A:
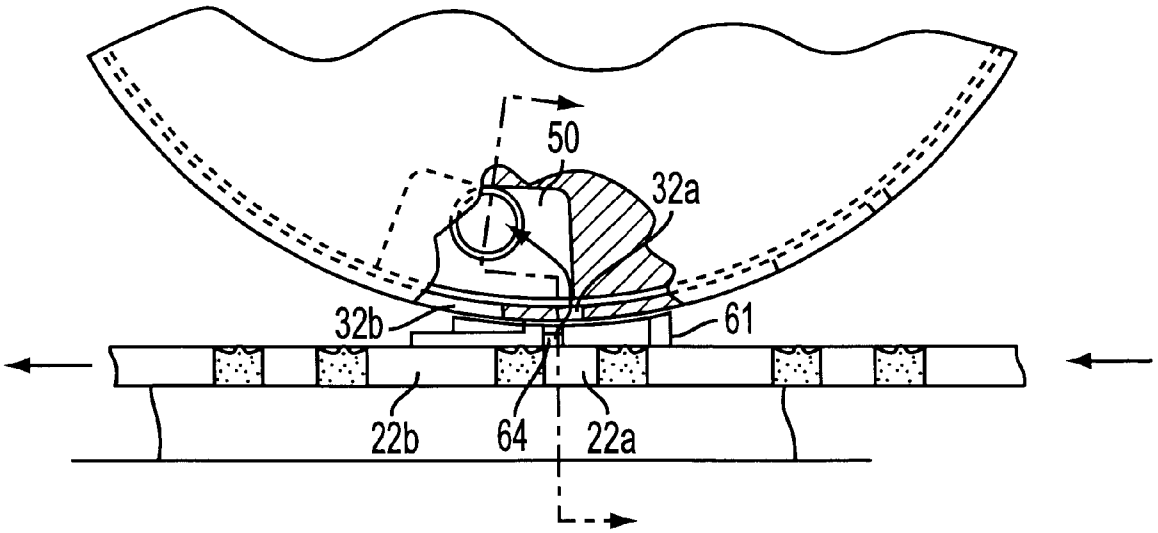
FIG. 4A illustrates a side elevation view of the cleaning system of FIG. 1A at a point when vacuum is first being applied to clean a filter component.
Figure 4B:
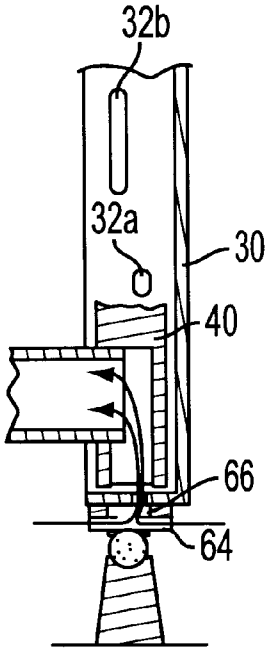
FIG. 4B illustrates a front elevation view of the cleaning system shown in FIG. 4A.

FIG. 3A shows a particle filled cavity 24 positioned underneath cross groove 64 of stationary shoe 60. In this position the ports 32*a*, 32*b* in ported wheel 30 do not line up with the radial passageway 66 in shoe 60. Accordingly, in the position shown in FIG. 3A, air is not pulled through the cross groove 64 and, as a result, the particles 70 in cavity 24 passing underneath the cross groove are not disturbed. As the combined filter rod 20 continues to travel to the left in FIG. 3A, and the wheel continues to rotate clockwise in FIG. 3A they both reach the position shown in FIG. 4A. As shown in FIG. 4A, the wheel port 32*a* begins to line up with the stationary vacuum chamber 50 and the radial passageway 66 in shoe 60. This alignment allows air to flow through the cross groove 64 in shoe 60 and cleans loose particles from the short filter component 22*a*.

Figure 5A:
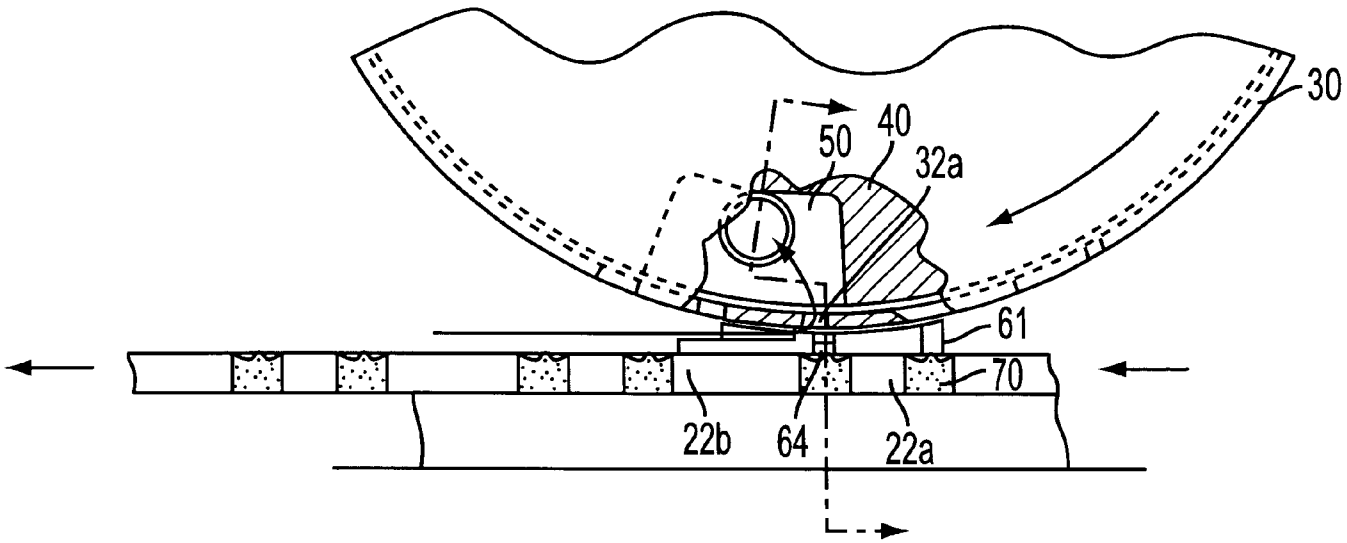
FIG. 5A illustrates a side elevation view of the cleaning system shown in FIG. 1A, at a point when vacuum is no longer applied to clean a filter component, but vacuum is being applied to clear away any collected particles.
Figure 5B:
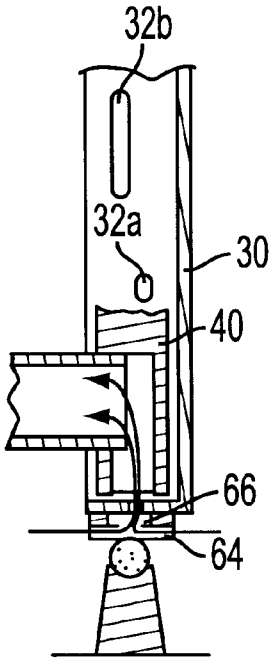
FIG. 5B illustrates a front elevation view of the cleaning system shown in FIG. 5A.

As the filter rod 20 and ported wheel 30 continue to travel, the entire length of the short filter component 22*a* is cleaned until the position shown in FIG. 5A is reached. As shown in FIG. 5A, air flow through cross groove 64 is blocked and air flow from ambient into port 32*a* begins at the end of concave segment 62*b* on the top surface 62 of shoe 60. This prevents the cross flow air from disturbing particles in the cavity 24 that is now passing underneath the cross groove 64 and allows air to continue to flow through port 32*a* to remove particles that were picked up.

Figure 6A:
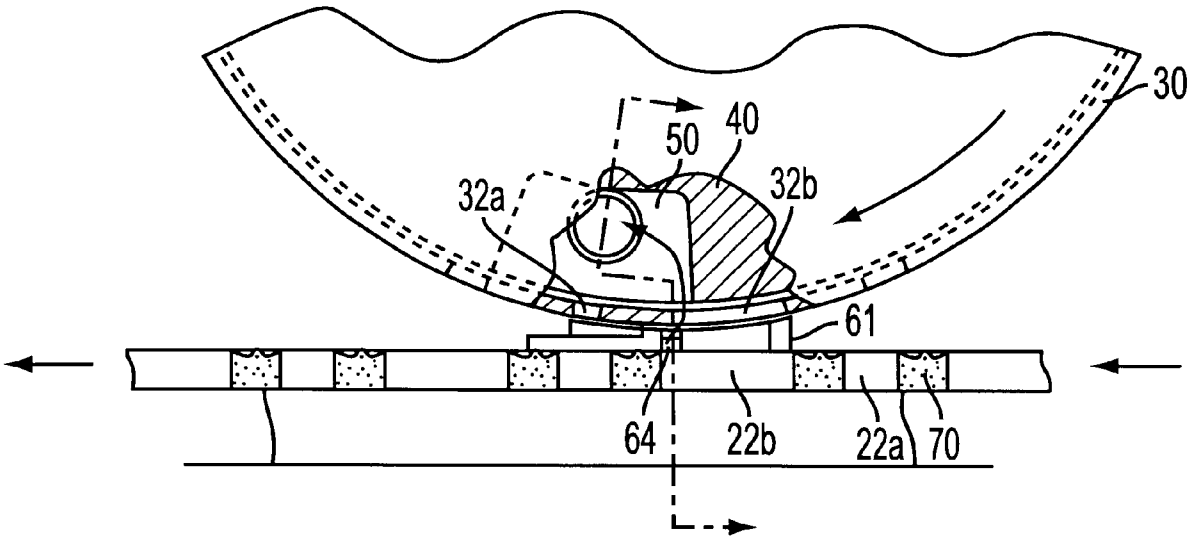
FIG. 6A illustrates the cleaning system shown in FIG. 1A at a point when vacuum is again being applied to clean a second longer filter component.
Figure 6B:
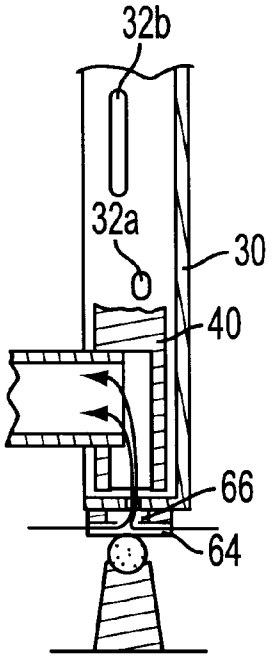
FIG. 6B illustrates a front elevation view of the cleaning system shown in FIG. 6A.

As the filter rod 20 and ported wheel 30 continue to travel, they reach the position shown in FIG. 6A. In this position air is again beginning to flow through cross groove 64 as vacuum is communicated from central stationary chamber 50 through the longer port 32*b* and through radial passageway 66 in shoe 60. Air flow through cross groove 64 cleans the longer filter component 22*b*. As the rod and wheel continue to travel, the entire length of the longer filter component 22*b* is cleaned until the position shown in FIG. 7A is reached.

Figure 7A:
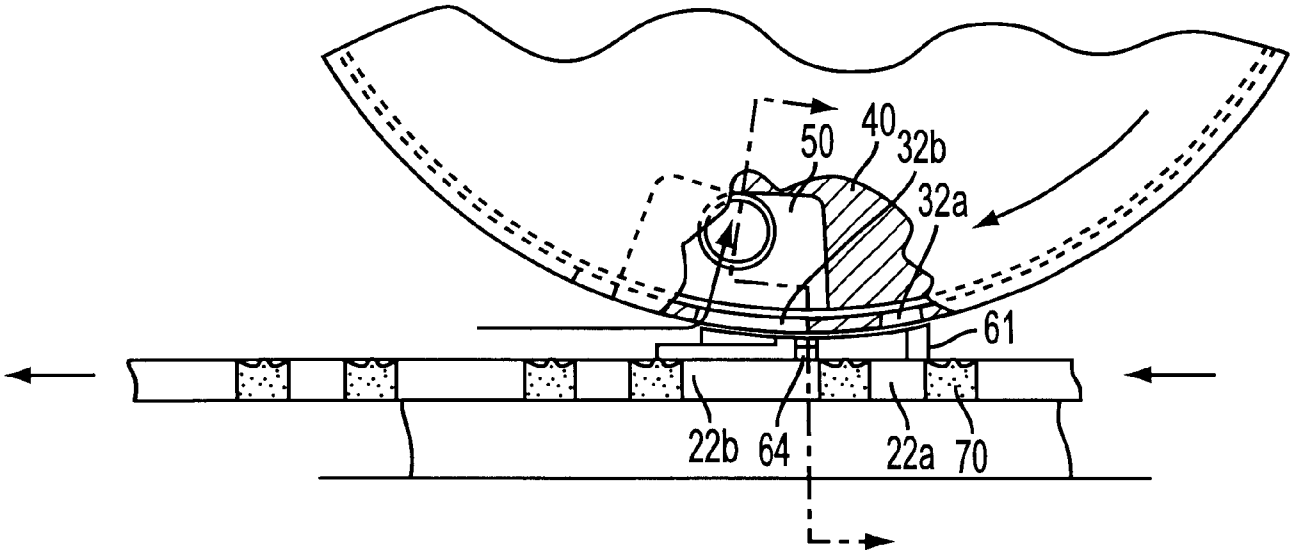
FIG. 7A illustrates a side elevation view of the cleaning system shown in FIG. 1A at a point when vacuum is no longer being applied to clean the longer filter component, but vacuum is being applied to remove any scattered particles that have been collected.
Figure 7B:
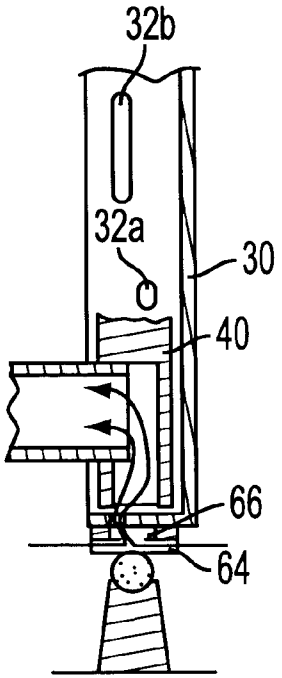
FIG. 7B is a front elevation view of the cleaning system shown in FIG. 7A.

At the position shown in FIG. 7A, the longer port 32*b* is passing beyond the radial passageway 66 through shoe 60, and air flow through the cross groove 64 is blocked so as to not disturb particles 70 in the next particle filled cavity 24. The leading edge of the long port 32*b* is clearing the end of the long concave segment 62*a*, thereby allowing surrounding air to flow into the longer port 32*b* to remove any particles that have been picked up.

Although an embodiment of the cleaning system has been shown and described, the invention is not limited to the described embodiment, and can encompass other arrangements within the scope of the attached claims. For instance, the ported wheel could include ports of the same size or a number of different length ports corresponding to a number of different length concave segments on the conforming upper surface of the stationary shoe. Vacuum can also be applied below the combined filter rod in order to assist in maintaining particles within the particle filled cavities 70 during the cleaning process. Although the embodiment is shown for a combined filter rod, the cleaning system could also be used for other articles having discrete cavities that are filled with granular particles and separated by areas where loose particles must be cleaned away.

What is claimed is:

1. A system for cleaning particles from surfaces of an article having cavities filled with the particles, comprising:

a stationary vacuum chamber;

a ported wheel that rotates around said vacuum chamber, bringing a plurality of ports spaced around said ported wheel into communication with said vacuum chamber; and a stationary vacuum applicator positioned between said ported wheel and an article to be cleaned, said vacuum applicator having an upper surface conforming at least partially to the outer peripheral surface of said ported wheel and a lower surface conforming at least partially to a surface of said article to be cleaned, and at least one through-hole connecting vacuum applied to said upper surface by the stationary vacuum chamber to said lower surface.

2. The system according to claim 1, wherein said ported wheel includes a first port having a first length and a second port having a second length different than said first length, said first and second ports being offset from each other in a direction parallel to an axis of rotation of said ported wheel; and said upper surface of said vacuum applicator having a first segment conforming to the outer peripheral surface of said ported wheel along a first length and being aligned with said first port, and a second segment conforming to the outer peripheral surface of said ported wheel along a second length different than said first length and being aligned with said second port.

3. The system according to claim 2, wherein said at least one through-hole connects to at least one groove extending at least part way across said bottom surface.

4. The system according to claim 3, wherein vacuum is communicated from said stationary vacuum chamber to said at least one through-hole in said stationary vacuum applicator when a port through said ported wheel is at least partially aligned with said at least one through-hole and completely covered by a conforming portion of said upper surface of said stationary vacuum applicator.

5. The system according to claim 4, wherein said first port is shorter than said second port and said first segment is shorter than said second segment.

6. The system according to claim 5, wherein said vacuum is communicated through a port to air surrounding the stationary vacuum applicator when at least part of said port is no longer covered by a conforming portion of said upper surface of said stationary vacuum applicator.

7. The system according to claim 1, further comprising a support on which the article travels under the stationary vacuum applicator, the article comprising a filter rod of a cigarette and the support comprising a vacuum rail.

8. A method of cleaning particles from surfaces of an article adjacent cavities in said article filled with the particles in an apparatus comprising a stationary vacuum chamber, a ported wheel that rotates around said vacuum chamber and a stationary vacuum applicator positioned between the ported wheel and the article, the stationary vacuum applicator having a first surface that conforms at least partially to the ported wheel, a second surface that conforms at least partially to the article, and at least one passageway connecting the first and second surfaces, the method comprising;

rotating the ported wheel and moving the article past the stationary vacuum applicator in synchronization with each other; and timing rotation of said ported wheel with movement of said article so that a port in said ported wheel communicates vacuum from said vacuum chamber to said at least one passageway when said at least one passageway is aligned with a surface of the article to be cleaned, and said port cuts off communication of said vacuum to said at least one passageway when said at least one passageway is at least partially aligned with one of said cavities.

9. The method according to claim 8, wherein a first port in said ported wheel is offset in the direction of the axis of rotation of said ported wheel from a second port, said first port being longer than said second port, said first port aligning with a conforming first portion of said first surface, and said second port aligning with a conforming second portion of said first surface, the method further comprising:

rotating said ported wheel in a direction of rotation such that at least a portion of said first port is uncovered by said conforming first portion of said first surface when said at least one passageway is at least partially aligned with one of said cavities; and continuing to rotate said ported wheel in said direction of rotation until at least a portion of said second port is uncovered by said conforming second portion of said first surface when said at least one passageway is at least partially aligned with another one of said cavities.

10. The method according to claim 8, wherein the article comprises a filter rod of a cigarette.

11. A system for cleaning particles or granules from surfaces of an article adjacent cavities in the article filled with the particles or granules, said system comprising:

a stationary vacuum chamber;

a ported wheel that rotates around said stationary vacuum chamber bringing successive ports in said wheel into communication with said stationary vacuum chamber; and a vacuum applicator having at least one first conforming surface in close proximity to said ported wheel, said at least one first conforming surface blocking communication of vacuum from said vacuum chamber through at least a first port in said wheel, at least one second conforming surface in close proximity to the article, and at least one passageway connecting the at least one first conforming surface to the at least one second conforming surface.

12. The system according to claim 11, wherein a first port in said ported wheel is longer than a second port in said ported wheel, said first and second ports being offset from each other in a direction parallel to an axis of rotation of said ported wheel.

13. The system according to claim 12, wherein said at least one first conforming surface of said vacuum applicator includes a first segment that aligns with said first port and a second segment that aligns with said second port.

14. The system according to claim 13, wherein said first segment is longer than said second segment.

15. The system according to claim 14, wherein the lengths of said first and second ports and the lengths of said first and second segments are proportional to distances between successive cavities in the article.

16. The system according to claim 15, wherein a slot is provided extending at least partway across the at least one second conforming surface and connected to the at least one passageway through the vacuum applicator.

17. The system according to claim 16, wherein said vacuum is communicated through a port to air surrounding the vacuum applicator when at least part of said port is no longer covered by a conforming surface of said vacuum applicator.

* * * * *